United States Patent [19]

Goldsmith

[11] 4,423,778

[45] Jan. 3, 1984

[54] CONCENTRIC TUBING SEPARATION JOINT

[75] Inventor: Burton Goldsmith, Lawndale, Calif.

[73] Assignee: Baker International Corporation, Orange, Calif.

[21] Appl. No.: 305,827

[22] Filed: Sep. 28, 1981

[51] Int. Cl.[3] ..... E21B 29/00

[52] U.S. Cl. ..... 166/134; 175/320; 285/138

[58] Field of Search ..... 166/297–298, 166/118–134, 302, 242, DIG. 1, 367; 285/47, 53, 371, 138, 140, 114–116, 187; 138/149, 113, 115, 148, 172; 52/233 R; 175/215, 320

[56] References Cited

U.S. PATENT DOCUMENTS

| | | | |
|---|---|---|---|
| 2,453,079 | 11/1948 | Rossmann | 52/223 R |
| 2,959,193 | 11/1960 | Guldenzoph et al. | 175/320 |
| 3,232,638 | 2/1966 | Hollander | 175/320 |
| 3,274,798 | 9/1966 | Wiggins, Jr. | 175/320 |
| 3,574,357 | 4/1971 | Alexandru et al. | 285/138 X |

*Primary Examiner*—Ernest R. Purser
*Assistant Examiner*—Thuy M. Bui
*Attorney, Agent, or Firm*—Norvell & Associates

[57] ABSTRACT

A concentric insulating tubular conduit string, including a separation joint comprising first and second couplings with concentric tubular sleeve members extending therebetween, is disclosed. An insulating conduit incorporating this integral separation joint could be employed for the delivery of a heated fluid, such as steam, through the conduit to the producing formation therebelow. The inner and outer tubular sleeves of the separation joint may be prestressed in tension and compression between axially spaced coupling members used to join the separation joint to the tubular conduit. One sleeve which may be prestressed in tension threadably engages both the upper and lower coupling members. The other sleeve which may be prestressed in compression threadably engages only one of the coupling members and abuts the other coupling member to carry compressive loads. This joint can be separated by merely severing the tensile loaded sleeve member and upon severance of this separation joint the conduit extending thereabove can be removed from a subterranean well.

30 Claims, 5 Drawing Figures

CONCENTRIC TUBING SEPARATION JOINT

BACKGROUND OF THE INVENTION

1. Field of the Invention

This invention generally relates to conduits for use in subterranean wells where provision must be made for the severance of the conduit at a predetermined position and, more particularly, to concentric wall insulated tubing conduits and separation joints for these concentric wall conduits which are used to convey a heated fluid, such as steam, into the subterranean well.

2. Description of the Prior Art

It is often necessary to provide a means for severing a tubing string in a subterranean well at a predetermined location. Perhaps the most common situation in which separation of the tubing string at a precise location is necessary is the use of shear-out safety joints in tubing strings employing a safety valve. In such cases it is necessary to sever the tubing string above the safety valve in an emergency. Shear-out safety joints are therefore incorporated above safety valves so that in case of a disaster at the well head, the tubing string will separate above the safety valve permitting the safety valve to shut off the well.

The concentric tubing separation joint comprising the preferred embodiment of this invention provides a means of separating the tubing string which is especially useful in connection with the use of concentric walled insulating tubing strings. In producing some subterranean wells, it is necessary to inject steam into an injection or producing well to increase the recovery of hydrocarbons by reducing the viscosity of the crude oil in the formation. One of the major problems in injecting steam into a subterranean production zone is that the heat transfer between the surface and the production zone is excessive when conventional well production tubing is utilized. Dual wall tubing structures having insulating material in the annulus between inner and outer walls welded at either end have been employed to reduce this heat loss. In U.S. Pat. No. 3,511,282 and in U.S. Patent application Ser. No. 272,411, filed June 10, 1981, the inner wall of a concentric walled insulated tubing section is prestressed in tension to relieve the stresses in the tubular sections when heated steam is injected. The exterior walls of these concentric walled tubing sections are conversely prestressed in compression. In each of these tubular conduit members, means are provided for rigidly attaching the inner wall to the outer wall at opposite ends of the tubing. The conventional means of providing this rigid attachment is to weld the inner tubular member to a bushing extending between the inner tubular member and the outer tubular member. In U.S. Patent application Ser. No. 272,411, filed June 10, 1981, the inner tubing is flared so that a single weld may be employed to attach the inner conduit to the outer conduit at either end. Despite the structural differences between these separate concentric tubular conduit assemblies it is quite apparent that each comprises a more complex and expensive structure than conventional oil well tubing. It is, therefore, most desirable that these tubular conduits and the welds incorporated therein not be damaged during operation.

The separation joint comprising the preferred embodiment of this invention therefore comprises a beneficial means for separating the tubing without risking damage to the more expensive insulated conduit. Perhaps the most common application of this separation joint would be its use in conjunction with the connection of insulated tubular conduit to a downhole packer. If for some reason a conventional packer employed in conjunction with an insulated tubular string cannot be released to permit retrieval of the tubular string, this separation joint would provide a means of releasing the tubing from the packer lodged in the wall.

SUMMARY OF THE INVENTION

A concentric walled separation joint incorporable in a tubing string used in a subterranean well comprises first and second concentric tubing members extending between axially spaced coupling members. The first tubular member is threadably attached to both the upper and lower coupling members and may be prestressed in tension. The second tubular member is threadably attached only to a first coupling member and abuts or engages the second coupling member so that only compressive loads are carried by the second tubular member. Tensile and compressive prestress may be incorporated into the inner first and second tubular members, respectively, by initially threading both members to the first coupling and subsequently threading the second coupling to the first tubular members. As the second coupling is threaded to the first tubular member, this member is placed in tension while a compressive flow is transferred to the second tubular member. An annular cavity, which can be filled with insulating material, is provided between the inner and outer tubular member. Incorporation of this separation joint between an insulating tubular conduit having inner and outer prestressed rigidly attached tubular members and an anchored device, means, such as a packer, permits retrieval of the tubing string while the anchored device remains in place.

DESCRIPTION OF THE PREFERRED EMBODIMENT

The concentric walled tubing separation joint depicted herein is especially adapted for use with concentric walled prestressed insulating tubing. It should be noted, however, that this separation joint can be employed with other more conventional tubing strings. The separation joint comprising the preferred embodiment of this invention can be employed wherever separation of the tubing at a particular location is desired. This separation joint is specifically adapted to permit separation after severance of the concentric wall member which carries tensile loads within the tubing string. This invention can therefore be employed whenever tubing separation is desired and it would be undesirable to sever that portion of the tube carrying compressive loads.

Figure 1:
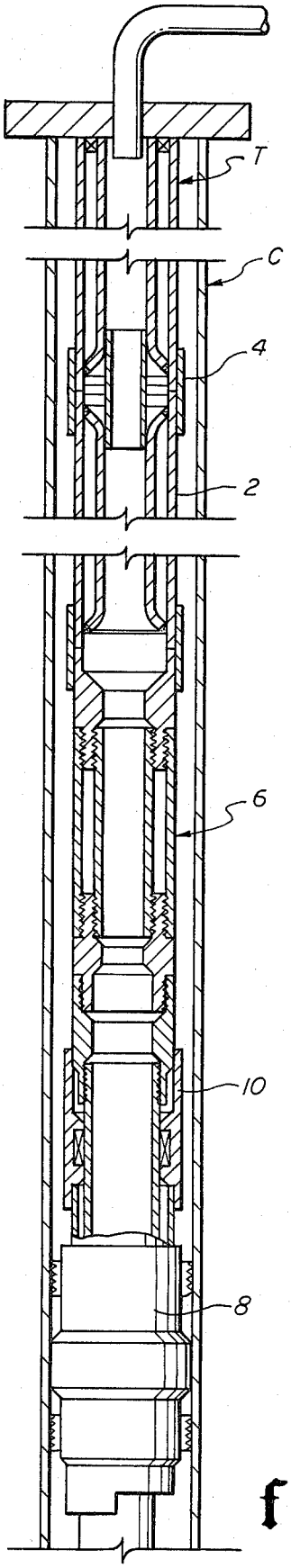
FIG. 1 is a schematic view illustrating a separation joint employed with insulated tubing and a packer.

As shown in FIG. 1, an insulating tubing string T inserted within an outer casing C may be effectively used to permit the injection of steam or some other heated liquid through the tubing T to a producing formation containing viscous fluids which cannot be produced in the absence of some treatment. A conventional packer 8 has been employed to seal the annulus between casing C and tubing T and to anchor the tubing string T at its lower end adjacent the formation. The tubing string T can comprise a plurality of individual insulating tubing sections 2, each attached to the other by means of a standard connection member 4. In the schematic view of FIG. 1, a separation joint 6 has been employed between the lowermost tubing section 2 and packer 8. It should be appreciated, however, that a separation joint 6 can be employed at any location within the tubing string where separation of the tubing string would be desirable.

Figure 2A:
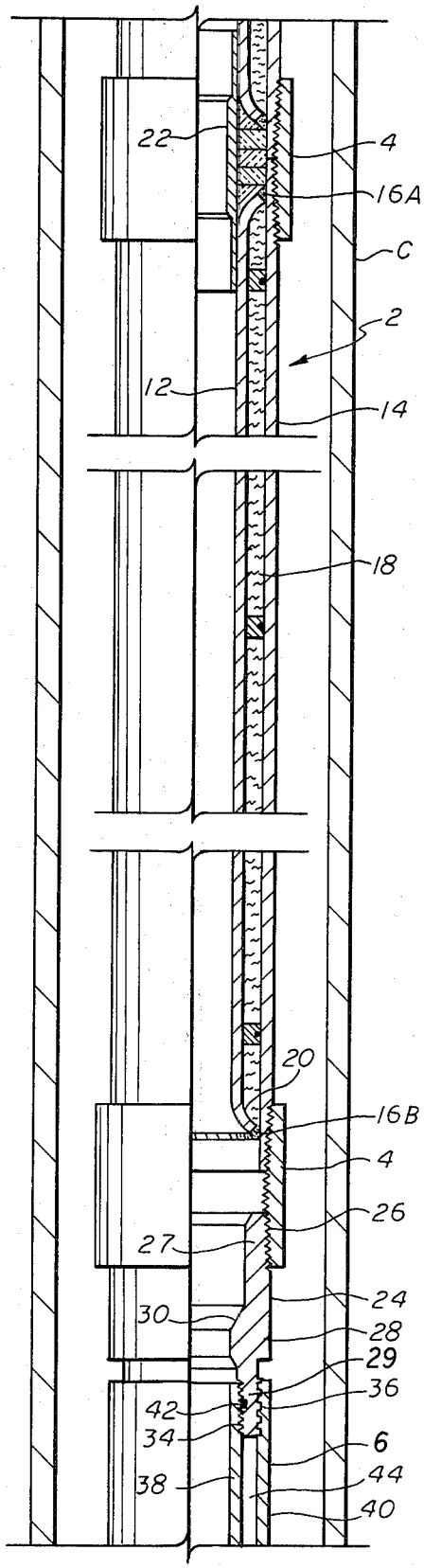
FIGS. 2A through 2C are running continuations illustrating the detailed construction of the separation joint and typical insulating tubing and packers with which this separation joint may be employed.

As shown more explictly in FIG. 2A, the insulating tubing sections 2 with which separation joint 6 may be employed comprise a concentric wall insulating member having an inner tubular member 12 and an outer tubular member 14. Each separate insulating tubing section 2 is formed by attaching the inner tubular member 12 directly to the outer tubular member 14 by means of two welds 16A and 16B. In the embodiment shown in this invention, each insulating tubing string employs curved or flared ends 20 adjacent each end of inner tubing member 12 to facilitate effective attachment of inner tubular member 12 to outer tubular member 14. It should be noted that the separation joint 6 employed in the preferred embodiment of this invention can be used with insulating tubing sections of somewhat different construction, and the separation joint 6 will perform its desired function in the same manner. Each insulating tubing section 2 also employs conventional insulating material 18 in the annular cavity formed between inner and outer tubular members 12 and 14. Adjacent sections of insulating tubing T are joined by conventional external connection members 4 which engage threads at the ends of outer tubular member 14. Inner connecting members 22 extend between adjacent inner tubular members 12 and together with insulation extending around the periphery of inner connecting member 22, appropriate heat transfer characteristics are maintained at each joint of the insulating tubing section.

Figure 2B:
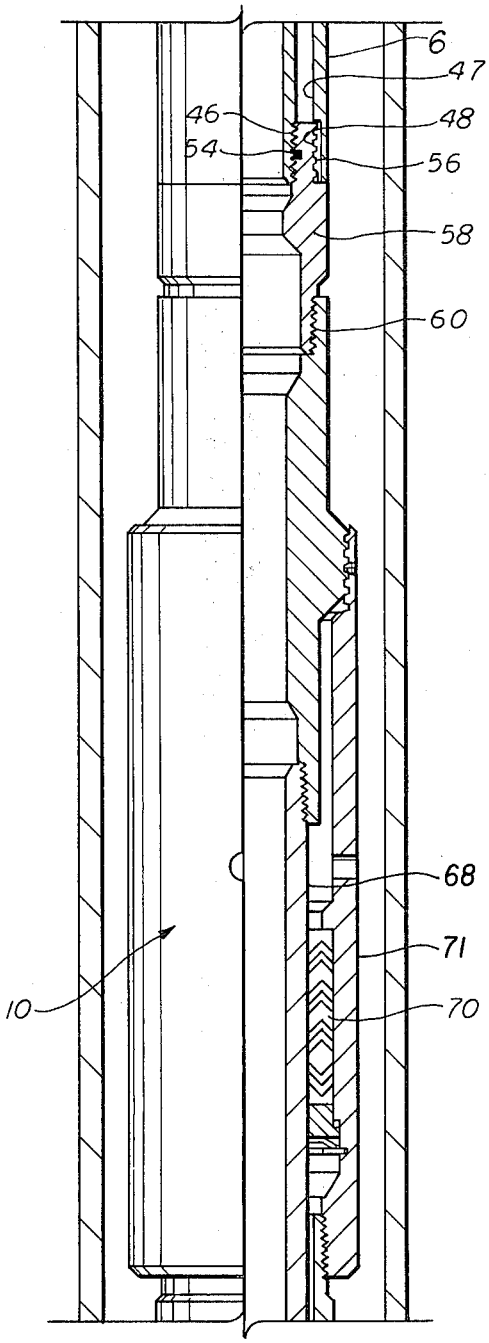
Figure 3:
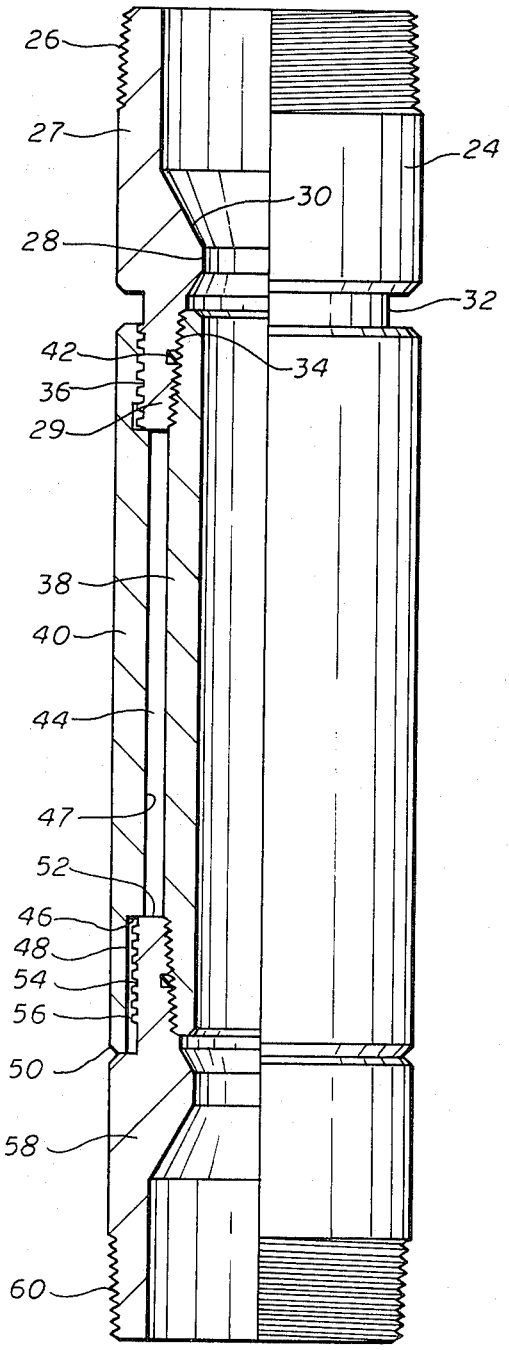
FIG. 3 is a view of the separation joint.

When it is desired to incorporate a separation joint 6 within the tubing string T, separation joint 6 may be attached to the end of an insulating tubing section 2 by means of a conventional connecting member 4. As shown in FIGS. 2A and 2B, connecting member 4 engages the threads 26 along the outer end of the first or upper coupling member 24. Coupling member 24 comprises a cylindrical member having a central section 28 with a relatively greater thickness than the upper and lower extremities of each coupling member 24. A conical surface 30 extends around the inner bore of coupling member 24 resulting in a reduction of the inner flow bore of coupling member 24. A lower section 29 of coupling member 24 is spaced relatively radially inward from the upper section 27 containing threads 26. Lower section 29 contains threaded elements 34 and 36 along its inner and outer peripheral surfaces, respectively. As shown in FIGS. 2B and 3, the pitch and size of the threads on the inner and outer surface do differ in the preferred embodiment of this invention. Separation joint 6 further comprises first and second tubular members or sleeves 38 and 40 which engage the threaded connections on the inner and outer surfaces, respectively, of the lower end of coupling member 24. First and second tubular members 38 and 40 comprise a concentric wall construction extending axially in separation joint 6. An annular cavity 44 is provided between first and second tubular members 38 and 40 in the preferred embodiment of this invention.

Insulating material can be inserted into annular cavity 44 to reduce the heat transfer through the separation joint. A blanket type insulation composed of mechanically bonded refractory fibers of the type manufactured by Johns-Manville under the trademarks "THERMO-MAT" or "CERATEX" may be employed to provide a convective insulating barrier. Note that a conventional O-ring seal 42 is positioned along threaded elements 34 on coupling 28 to provide an elastomeric metal-to-metal seal with the upper end of first tubular member 38. Although first tubular member 38 employs similar threads at its upper and lower outer ends, second or outer tubular member 40 has dissimilar ends. As shown in FIG. 3, the upper end attached to first coupling member 24 has a mating threaded connection for engaging upper coupling 24. The lower end of outer tubular member 40, however, has a stepped configuration with a downwardly facing inner shoulder 46 spaced axially from a beveled or outer shoulder 50. An axially extending surface 48 spaced from the inner surface 47 of member 40 extends between these two downwardly facing shoulders. Axially extending surface 48 is positioned adjacent the threaded elements 56 along the exterior of the second or lower coupling member 58. Outer tubular member 40 does not engage threads 56 on lower coupling member 58. Lower coupling member 58 in the preferred embodiment of this invention is a duplicate of upper coupling member 24 having similar threaded elements 54 and 56 along the inner and outer peripheral surface of its interior or upper section. Threaded connection elements 60 are provided along the exterior of the distal end of coupling member 58 for connection with a suitable conventional connecting member 4. It should be understood that the orientation of the separation joint 6 can be reversed without affecting its operation.

Figure 2C:
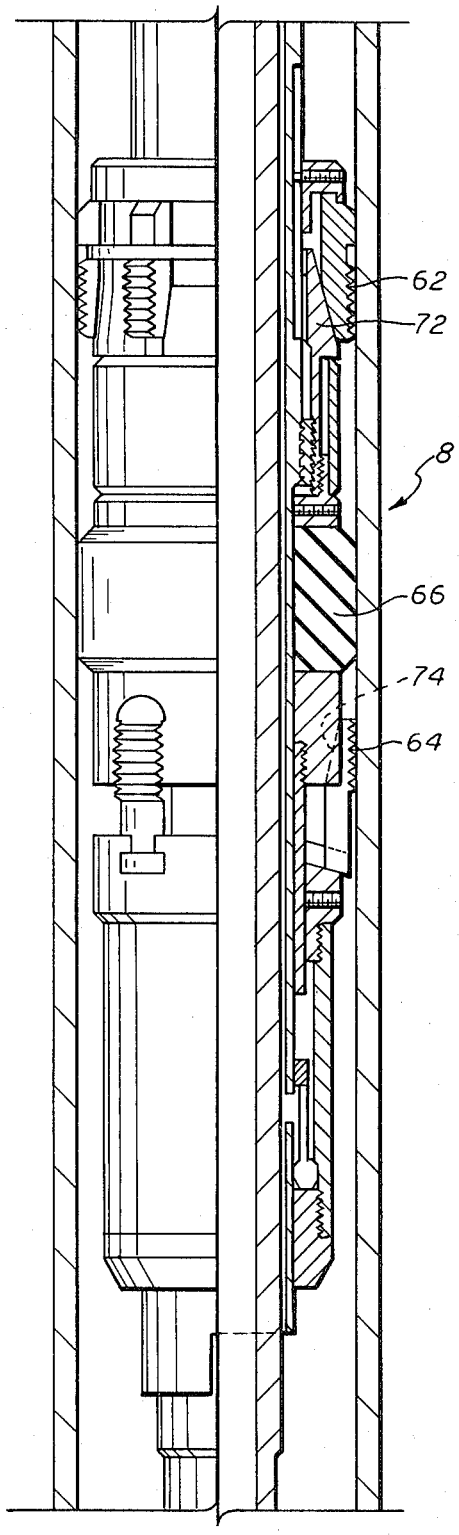

When used with concentric insulated tubing, separation joint 6 will normally be attached to the upper end of a packer 8 which may incorporate an integral expansion joint 10. Packer 8 serves to isolate the annulus between the tubing and the casing and radially expandable upper and lower slips 62 and 64 serve as anchoring means to engage the outer casing and to secure the tubing string to the outer casing. Packing element 66 establishes sealing integrity between the packer and the outer casing and isolates the annulus above the packer from the annulus below. Any number of conventional packers may be employed with the assembly shown in the preferred embodiment of this invention. The packer 8 depicted in FIG. 2C is, however, specifically adapted for use in high temperature environments in which insulated tubing of the type depicted herein will be necessary. This packer employs an integral expansion joint 10 mounted above the slips 62 and 64 and packing elements 66. This expansion joint employs an inner mandrel member 68 which engages seals 70 located on the outer housing 71 of the expansion joint. This packer is set in a conventional manner by applying tension to the tubing string. This tension is transmitted through the packer to cause upper slip cones 72 to move beneath upper slips 62 causing them to move radially outward into engagement with the casing. Lower slips 64 also move relative to cooperating conical surfaces 74 to cause the lower slips 64 to also engage the casing. Tension applied to the tubing string also results in relative movement of the packer resulting in compression and radial expansion of packing element 66. Packer 8 may be released by applying additional tension to the tubing string to disengage upper and lower slips 62 and 64 from upper and lower cones 72 and 74.

Although use of the specific packer shown in FIG. 2C is not essential to the function of this invention, it should be clear that separation joint 6 not only provides a means of separating the tubing string at a desired point but it also permits the transmission of tensile forces through the tubing string to a packer located therebelow. Separation joint 6 becomes critical when a packer, such as packer 8 shown in FIG. 2C, cannot be released in a conventional manner. It is therefore necessary to separate the tubing string from the anchored packer to salvage the tubing string. Separation joint 6 provides a convenient means for separating the tubing string above joint 6 from the tubing and packer extending therebelow. A suitable cutting means can be inserted into the well to cut one of the two concentric tubular members in separation joint 6. In the embodiment shown herein, a cutting member inserted through the tubing string permitting internal cutting can be used to cut inner tubular member 38. In this preferred embodiment, outer tubular member 40 is not securely attached to lower coupling 58, but it will continue to support the tubing string thereabove after the inner member is severed. After the inner tubular member has been cut, the outer tubular member can be separated from the second coupling 52 by merely picking up on the tubing string.

Separation joint 6 can be employed with a conventional tubing string but its use is especially desirably when used with concentric walled insulated tubing. Concentric walled insulated tubing is used where steam injection through the tubing is employed. Steam injection can result in excessive heating in the tubing and some means of accounting for the stresses induced by this heating must be provided. The insulated tubing sections shown in FIGS. 1 and 2 are adapted to account for these stresses by providing for the use of inner and outer prestressed tubing members in each separate insulated tubing section 2. Insulated tubing section 2 comprises an inner tubular member 12 attached to an outer tubular member 14. Inner tubular member 12 is normally prestressed in tension prior to originally attaching the inner tubing to the outer tubing. This tensile prestress is incorporated to reduce these stresses on the tubing components at elevated temperatures. The tensile prestressed inner tubing member will not elongate when heated, and therefore will not promote excessive loads on the rigid connection to the cooler outer tubular member. The initial prestress of the inner tubular member will result in a prestressed compression existing in the outer tubular member 14. Separation joint 6 employs a similarly tensile prestressed inner tubular member or sleeve 38 and a compressively prestressed outer tubular member 40. Prestress may be incorporated into tubular members 38 and 40 by first attaching these tubular members to the appropriate threaded connections on first coupling 24. Second coupling 52 58 can now be attached to the opposite end of inner tubular member 38. Note that outer tubular member 40 has not cooperating threads at its lower end. As lower coupling member 58 is rotated into threaded engagement with inner tubular member 38 continued rotation will apply a tensile load to the inner tubular member while applying a compressive load to the outer tubular member. The desired tensile and compressive prestress can thus be incorporated into separation joint 6 during assembly.

Tensile and compressive prestress may also be incorporated into the separation joint by other methods. For example, the first tubular member 38 may be heated thus causing that member to expand. The second tubular can then be attached to both coupling members and the entire assembly allowed to cool. Upon cooling, the first tubular member will be prestressed in tension and the second tubular member will be prestressed in compression.

Separation joint 6 is then ready for incorporation into an insulated tubing string in a subterranean well. Normally, the first coupling member 24 will be attached to an insulated tubing section 2 by means of a conventional connection member 4. The lower coupling 58 can then be attached to a packer or expansion joint extending therebelow. Separation joint 6 can, however, be incorporated into the tubing string between separate insulated tubing sections 2 to permit potential retrieval of any portion of the tubing string desired.

Although the invention has been described in terms of the specified embodiment which is set forth in detail, it should be understood that this is by illustration only and that the invention is not necessarily limited thereto since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A separation joint incorporable in a tubular string in a subterranean well comprising: first and second coupling members attachable to said tubular string; a first tubular member in prestress tension attached at opposite ends there of to said first and second coupling members; and a second tubular member extending concentrically to said first tubular member secured to one of said coupling members and engaging the other of said coupling members to carry only compressive loads exerted through said first and second coupling members, said second tubular member being tension in said first tubular tubular member separates said tubular string at said separation joint.

2. The separation joint of claim 1 wherein said first tubular member is threadably engaged to said first and second coupling members.

3. The separation joint of claim 1 wherein said second tubular member is threadably engaged to said first coupling member.

4. The separation joint of claim 3 wherein said second tubular member abuts said second coupling member with compression loads being transferred from said second coupling member to said abutting second tubular member.

5. The separation joint of claim 1 wherein said first tubular member is spaced from said second tubular member to form an annular cavity therebetween.

6. The separation joint of claim 5 wherein insulating material is contained within said annular cavity.

7. The separation joint of claim 1 wherein said first and second coupling members are identical.

8. The separation joint of claim 1 wherein said first tubular member comprises an inner tubular member and said second tubular member comprises an outer tubular member.

9. A separation joint for use in disengaging a tubular string in a subterranean well comprising: first and second coupling members attachable to said tubular string on the exterior ends thereof; threaded elements on the inner and outer peripheral surfaces of the interior ends of said coupling members; a first tubular member threadably engaging the threaded elements along one corresponding peripheral surface of the interior end of both coupling members; a second tubular member threadably engaging the other threaded elements on the interior end of the first coupling member and abutting said second coupling member free of engagement of the other threaded elements on said second coupling member with rotation of said second coupling member relative to said first and second tubular members placing said first tubular members in tension and said second tubular member in compression with severance of said first tubular member disengaging said separation joint.

10. The separation joint of claim 9 wherein first and second tubular members are spaced apart to form an annular cavity therebetween.

11. The separation joint of claim 10 further comprising insulating means for reducing the transfer of heat between said first and second tubular members, the insulating means being disposed in said annular cavity.

12. The separation joint of claim 9 wherein said first tubular member comprises an inner tubular member.

13. An insulating tubular conduit incorporable into an insulating tubular string comprising: a first prestressed section comprising inner and outer concentric tubular members having a rigid attachment therebetween at each end thereof, said inner and outer concentric tubular members being prestressed in tension and compression one to another; and a second prestressed section attached to said first prestressed section comprising a first sleeve attached to one end of said first prestressed section and extending between said one end and an axially spaced coupling member in tension prestress relative to a second concentric sleeve being in compression between said first prestressed section and said axially spaced coupling member, said second concentric sleeve being disengageable from one of said first prestressed section and said axially spaced coupling member upon severance of said first sleeve.

14. The conduit of claim 13 further comprising an intermediate coupling between said first prestressed section and said first sleeve.

15. The conduit of claim 14 wherein said first sleeve is threadably engaged to said intermediate and said axially spaced coupling members.

16. The conduit of claim 14 wherein said second concentric sleeve is threadably engaged to one of said intermediate and said axially spaced coupling members.

17. The conduit of claim 16 wherein said second sleeve abuts the other of said intermediate and axially spaced coupling members with compression loads being transferred from said other coupling member to said abutting second sleeve.

18. The conduit of claim 13 wherein said first sleeve is spaced from said second sleeve to form an annular cavity therebetween.

19. The conduit of claim 13 wherein insulating material is contained within said annular cavity.

20. The conduit of claim 13 wherein said axially spaced and intermediate coupling members are identical.

21. The conduit of claim 13 wherein said first sleeve comprises an inner sleeve and said second sleeve comprises an outer concentric sleeve.

22. An assembly comprising an insulating tubular conduit, extending through an outer casing, for transporting a heated liquid or gas therethrough to a formation in a subterranean well, comprising: a plurality of tubular sections, each tubular section comprising a first prestressed in tension tubular member rigidly attached at both ends to a first concentric prestressed in compression tubular member; an anchoring member, engaging said casing holding the insulating tubular conduit affixed to said casing; and a separation joint above said anchoring member and incorporated in said insulating tubular conduit, comprising a second prestressed in tension tubular member attached to first and second coupling members at each end thereof and a second concentric prestressed in compression tubular member abutting said coupling members, said separation joint being separable upon severance of only said second prestressed in tension tubular member to disengage the tubular conduit above said separation joint from said anchoring member.

23. The assembly of claim 22 wherein said separation joint comprises a first prestressed in tension tubular member threadably engaging said first and second coupling members.

24. The assembly of claim 22 wherein said separation joint comprises said second prestressed in compression tubular member threadably engaging said first coupling member.

25. The assembly of claim 24 wherein said separation joint comprises said second prestressed in compression tubular member abutting said second coupling member with compression loads being transferred from said coupling member to said abutting second prestressed in compression tubular member.

26. The assembly of claim 22 wherein said separation joint comprises said first prestressed in tension tubular member spaced from said second prestressed in compression tubular member to form an annular cavity therebetween.

27. The assembly of claim 26 wherein said separation joint further comprises insulating means for reducing the transfer of heat between said first and second tubular members, the insulating means being disposed within said annular cavity.

28. The assembly of claim 22 wherein said separation joint comprises first and second identical coupling members.

29. The assembly of claim 22 wherein said separation joint comprises an inner tubular member prestressed in tension and an outer tubular member prestressed in compression.

30. The assembly of claim 22 wherein said anchoring member comprises a packer.

* * * * *